United States Patent [19]

Dorf

[11] 4,118,087

[45] Oct. 3, 1978

[54] RECREATIONAL VEHICLE SHELF BARS

[76] Inventor: Helen A. Dorf, 5265 Home Gardens Dr., Reno, Nev. 89502

[21] Appl. No.: 745,412

[22] Filed: Nov. 26, 1976

[51] Int. Cl.[2] ..... A47B 81/00

[52] U.S. Cl. ..... 312/291; 312/313; 211/105.6; 211/153; 211/184

[58] Field of Search ..... 312/291, 313; 211/105.6, 184, 153, 189; 52/690, 311, 239

[56] References Cited

U.S. PATENT DOCUMENTS

| | | | |
|---|---|---|---|
| 943,151 | 12/1909 | Marceau | 211/105.6 |
| 1,140,570 | 5/1915 | Buckley | 211/105.6 |
| 1,549,192 | 8/1925 | Foster | 52/690 |
| 2,519,996 | 8/1950 | Blake | 211/105.6 |
| 2,973,870 | 3/1961 | Schoos | 211/105.6 |
| 3,752,324 | 8/1973 | Moser | 312/291 |
| 3,757,958 | 9/1973 | Kirkemo | 312/291 |
| 3,792,917 | 2/1974 | Martinez | 211/189 |
| 3,851,765 | 12/1974 | Cox | 312/291 |
| 3,938,872 | 2/1976 | Hagerman | 312/291 |
| 3,987,807 | 10/1976 | Varnell | 211/105.6 |

FOREIGN PATENT DOCUMENTS

| | | | |
|---|---|---|---|
| 1,337,034 | 7/1963 | France | 211/105.6 |

*Primary Examiner*—Mervin Stein
*Assistant Examiner*—Victor N. Sakran
*Attorney, Agent, or Firm*—LeBlanc & Shur

[57] ABSTRACT

A protective, retaining device for shelf items stored in refrigerated or unrefrigerated enclosures to protect the items from spilling or breakage when the enclosure is jarred or moved is disclosed. The device of this invention is particularly adapted for use in recreational vehicles. The device consists of parallel, mutually spaced rods interconnected by at least one support. Each of said rods telescopes, and is longitudinally adjustable and spring-loaded. In addition, each rod has a skid resistant foot at either end so that the device may be mounted between opposed structural walls to retain objects on storage shelves while permitting access to the objects without removal of the retaining device of this invention.

1 Claim, 7 Drawing Figures

RECREATIONAL VEHICLE SHELF BARS

This invention relates to a retaining device for shelf-stored items in cupboards, refrigerators, and the like on recreational vehicles, in particular. Specifically, this invention relates to a retaining device for shelf-stored items in relatively small storage enclosures which will keep said items upright and on the shelf while still permitting access to said items without the removal of the retaining device or devices of this invention.

Because recreational vehicles are intended to encounter a variety of different types terrain, storage of containers of food, dishes, and relatively small articles, when vehicles are in motion has presented a continuing problem. Refrigerated food containers typically are of a variety of shapes and must be maintained in an upright position. Non-refrigerated articles such as household cleaning products and the like also require storage in an upright position. Furthermore, many articles to be stored are breakable and must not be permitted to move about within storage shelves or impact upon adjacent articles if the vehicle travels over rough terrain.

Recreational vehicles including mobile homes, campers, trailers, and even boats are designed for maximum utilization of space available. For this reason, storage compartments vary in size and shape. It is desirable then to provide not only a strong and durable means for retaining articles in an upright position on shelves, but to provide retainers adaptable to different types and sizes of shelves.

In addition, shelf retainers should permit unrestricted access to the contents of the shelf for removal of items thereon. It is not desirable from the standpoint of efficiency to utilize shelf retainers that must be removed to secure access to the contents of the shelf and then replaced before the vehicle can be moved.

Prior shelf retainers and guards are described in U.S. Pat. Nos. 3,752,324; 3,757,958; 3,851,765; and 3,938,872. In U.S. Pat. No. 3,938,872, the retainer is a plurality of cross-hatched elastic bands adapted to cover the front of shelves in a refrigerator. This type of retainer would retain the articles on the shelf but would not stop movement of articles on a particular shelf unless the shelf was actually full. Furthermore, this type of retainer provides only limited access to the interior, due to the mesh formed by the interconnecting bands.

In U.S. Pat. Nos. 3,752,324 and 3,757,958, retainers adapted to be attached to the front edges of several shelves are described. These retainers do permit limited access to the shelf interior without removal. However, these retainers do not prevent articles on the shelves from moving unless the shelf is full. The retainer described in U.S. Pat. No. 3,851,765 does address the problem of a nearly empty shelf in that the retainer is flexible and may be mounted within the shelf against the articles present. However, in the case of this patent and the previous two mentioned above, the method for attachment requires that the devices be attached to a grid-type shelf which will permit suspending or mounting the retainer on the shelf by engaging individual cross pieces. Accordingly, this type of adapter is limited to such a shelf and could not be utilized in the bottom of a refrigerator, or on a conventional solid shelf as would be found in a cupboard.

The instant invention, however, overcomes the problems associated with the prior art by providing a shelf retainer adapted to extend across the shelf between opposed side walls of the storage compartment. The device of this invention then is not attached to or supported by the individual shelves, and does not extend beyond the storage space occupied on a single shelf. The device of this invention then may be inserted into the storage area above the shelf and positioned to retain objects on the shelf against relative movement even though the shelf is not full.

The device of this invention utilizes parallel, mutually spaced telescoping rods which are spring loaded and laterally adjustable. The rods are spaced by, in one embodiment, a solid spacer, and in another embodiment, bar type spacers. Opposing ends of each rod are covered by a skid resistant rubber foot. Accordingly, the device of this invention may be inserted into the storage area over each shelf and retained between the opposed side walls to retain objects on the shelf without regard to whether the shelf is constructed in an open framework as normally found in a refrigerator, or is a solid shelf as in a cupboard.

Longitudinal adjustment of the individual rods is provided through co-action of a crimp on the internal end portion of the smaller telescoping tube and a coil spring disposed therein. By rotating the inner tube relative to the outer tube then the overall length of the rod may be changed to conform to storage space of different sizes.

Accordingly, it is an object of this invention to provide a retainer device for shelf stored articles which may be utilized whether the shelf is full or not, to retain articles against relative movement if the storage compartment is jarred or bumped.

It is another object of this invention to provide a retainer for shelf stored articles which is adapted to extend between opposed side walls of a storage compartment and which does not attach to the individual shelf.

It is yet another object to provide a retainer for shelf stored articles which will permit access to the articles on the shelf for removal without removal of the device.

It is still another object of this invention to provide a bar-type retainer for refrigerators, cupboards or the like which extends between opposed side walls to hold objects therein against each other and against the rear wall of the compartment so that as the storage compartment is jarred or bumped, the objects will not spill, turn over, or impact against each other.

These and other objects will become readily apparent with reference to the drawings and following description wherein.

Figures 1, 2, 3, 4A, 4B, 5, 6:
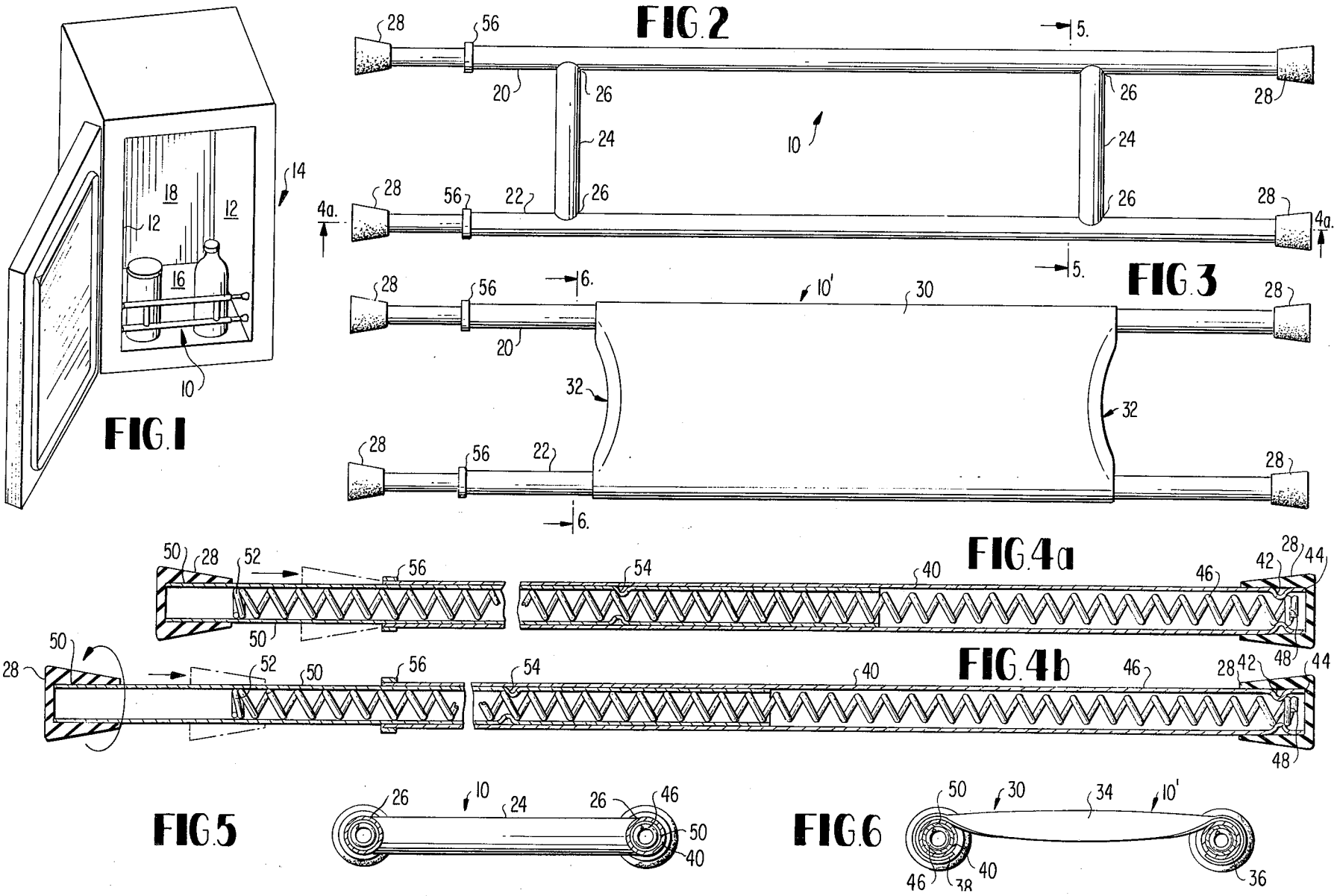
FIG. 1 is a perspective view of a storage compartment utilizing an embodiment of this invention as a shelf retainer for articles stored therein.
FIG. 2 is a front view of an embodiment of this invention.
FIG. 3 is a front view of an alternate embodiment of this invention.

FIG. 4*a* is a cross-sectional view taken along lines 4*a*—4*a* of FIG. 2;

FIG. 4*b* is an alternate version of FIG. 4*a* illustrating longitudinal extensions thereof;

FIG. 5 is a cross-sectional view taken along line 5—5 of FIG. 2;

FIG. 6 is a cross-sectional view taken along line 6—6 of FIG. 3.

With attention to the drawings, and in particular to FIG. 1, as will be subsequently explained, the device of this invention 10 is intended to be disposed between adjacent side walls 12 of a storage compartment 14 which may be a refrigerator, cupboard, or the like. The retaining device 10 may be utilized in the forward area of the shelf as shown in FIG. 1, or the objects resting on the shelf 16 may be retained by device 10 against the back wall 18 against relative movement on the shelf 16.

It will be obvious to those skilled in the art that a plurality of shelves may be enclosed within compartment 14, and one or more devices 10 may be mounted on each shelf as desired. In other words, if the objects to be retained are both small and large, on a single shelf, they may be grouped behind more than one device 10. In addition, the objects to be retained on the shelf need not be disposed against the rear wall 18, but may be sandwiched between front and rear mounted retaining devices 10 (not shown).

FIGS. 2 and 3 show alternate embodiments 10 and 10' of the retaining device of this invention. Embodiments 10 and 10' utilize upper and lower spring loaded telescoping rods 20 and 22, respectively.

Rods 20 and 22 are mutually spaced, in embodiment 10 by at least two cylindrical spacer members 24. Members 24 may be welded or soldered at their terminal portions 26 to, respectively, rods 20 and 22. As will be obvious to those skilled in the art, a plurality of spacer members 24 may be provided as desired.

The terminal portions of both rods 20 and 22 mount feet 28 which are preferably rubber cups. Feet 28 provide a non-skid surface whereby when the device 10 or 10' is mounted within an enclosure 14 against opposed side walls 12, bumping or jarring of enclosure 14 will not displace the device 10.

With attention to FIG. 3, in embodiment 10', the spacer member is a wrap-around solid piece 30. The ends 32 of piece 30 have, as shown in FIG. 6, a central rounded portion 34 which provides not only transverse stability, but additional support in spacing upper and lower rods 20 and 22. Accordingly, because spacer 30 utilizes the central rounded portion 34 together with a wrap-around feature of the upper and lower ends 36, and 38 around rods 20 and 22, the device 30 is maintained on rods 20 and 22 without soldering or welding unless such is desired.

With attention to FIGS. 4*a* and 4*b*, each rod 20 and 22 comprises an outer tube 40 having a foot 28 at an end thereof, and an internal crimp 42 also at the end 44. A coil spring 46 is disposed within tube 40, and the end 48 of spring 46 is fixed within tube 40 by crimp 42. The end of tube 40 opposite crimp 42 receives an internal tube 50 of a diameter less than that of tube 40. Internal tube 50 also receives the end 52 of spring 46 opposite the end 44 attached within tube 40 by crimp 42. Centrally of tube 40, a crimp 54 is provided to enclose a central portion of spring 46. An end 56 of tube 50 mounts a foot 28 in the manner described above. A terminal stop 56 is provided on the end of tube 40 opposite end 44.

Longitudinal adjustment of rods 20 or 22 is provided merely by rotating tube 50 within tube 40. With attention to FIGS. 4*a* and 4*b*, it will be observed that as tube 50 is rotated relative to tube 40, crimp 54 acts as a follower on the coils of spring 46. Accordingly, one end of spring 46 is fixed by crimp 42 in tube 40, and as tube 50 is rotated, the tube will be displaced relative to the end 52 of spring 46. In a preferred embodiment of this invention, the rods 20 and 22 are adjustable from a total length of 16 inches to a total length of 24 inches and approximately ½ inch of resilience is permitted by spring 46 at any given position of tube 50 relative to tube 40. Accordingly, in order to mount the device of this invention within an enclosure, the rods 20 and 22 are longitudinally adjusted to within about ½ inch of the space between opposed walls 12. The tube 50 is then compressed manually into tube 40 and the device inserted into the enclosure. The spring 46 is then permitted to expand urging feet 28 into opposed walls 12.

Accordingly, the device of this invention may be disposed at any place between the front and rear of an enclosure and may be mounted therein without regard for the type of shelf upon which articles are stored. The device of this invention will retain articles on a given shelf whether the shelf is a solid piece, or a refrigerator grill-type shelf. In addition, if the articles to be retained are relatively small, an embodiment of this invention 10' may be utilized, which embodiment includes a solid spacer 30 extending between the opposite ends of rods 20 and 22. In the alternative, at least two cylindrical spacers may be utilized. Furthermore, articles to be stored may be either retained by the device of this invention against the rear wall of an enclosure, or sandwiched between two of such devices as desired.

Accordingly, the device of this invention, as hereinabove described, may be utilized to retain articles on shelves without regard for the configuration of the storage space, the type of shelf, the number of articles, or similar considerations so long as opposed side walls of said enclosure may be utilized for support.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A retainer for articles normally disposed within a vehicle storage enclosure having opposed, side walls, a back wall and at least one shelf member for supporting articles within said enclosure on said shelf member against relative movement thereof, said retainer comprising:

a pair of mutually spaced, biased telescoping rods, each of said rods mounting a skid resistent foot at either end thereof, each of said rods comprising an outer tube and an inner tube, an end portion of said outer tube receiving an end of said inner tube, and a coil spring extending through said outer tube, through the end portion of said inner tube received therewithin and into the central portion of said inner tube;

means carried by each of said rods for changing the length thereof so that said feet lie a predetermined distance apart, said means comprising a first crimp on said outer tube adjacent the foot mounted thereon, engaging an end of said spring, and a second crimp on said inner tube adjacent the end received within outer tube whereby rotation of said inner tube relative to said outer tube will alter the distance between said feet, said spring normally urging the ends thereof outwardly to dispose said feet at said predetermined distance whereby when said distance is greater than the distance between opposed faces of said sidewalls and said rods are disposed within said enclosure, said spring will urge the ends of said rods into said walls;

and at least one vertical spacer member rigidly connecting the outer tube of said rods and spacing the longitudinal axes of said rods in a parallel relationship, substantially close together one to the other, so that said retainer may be inserted into said enclosure above said shelf member and abutting the articles to be retained thereon to confine the articles with said enclosure back and side walls against relative movement thereof, said spacer member being a substantially rectangular plate mounted on the central portion of said rods and having opposed longitudinal edge portions wrapped, respectively, around the central portion of the adjacent rod outer tube and transverse edge portions between said rod folded toward the center thereof.

* * * * *